US005878788A

United States Patent [19]

Gurry

[11] Patent Number: 5,878,788

[45] Date of Patent: Mar. 9, 1999

[54] WIRE BENDING JIG FOR JEWELRY MANUFACTURE

[76] Inventor: Corrine Frances Gurry, P.O. Box 50312 12201 SE. 25th St., Bellevue, Wash. 98015-0312

[21] Appl. No.: 73,803

[22] Filed: May 6, 1998

[51] Int. Cl.[6] ..... B21F 1/06

[52] U.S. Cl. ..... 140/92.1; 29/896.4; 140/71 R

[58] Field of Search ..... 248/220.31, 220.43; 29/896.4, 896.41; 72/457, 460; 140/71 R, 92.1, 102.5, 106, 123

[56] References Cited

U.S. PATENT DOCUMENTS

| | | | |
|---|---|---|---|
| D. 285,163 | 8/1986 | Nesel . | |
| D. 319,376 | 8/1991 | Young . | |
| 485,964 | 11/1892 | Mendelson | 140/71 R |
| 1,042,112 | 10/1912 | Hartman | 140/71 R |
| 1,076,521 | 10/1913 | Sample et al. | 72/460 |
| 1,319,881 | 10/1919 | Louder | 72/457 |
| 3,633,096 | 1/1972 | Bollman . | |
| 3,653,411 | 4/1972 | Mosher et al. . | |
| 3,672,408 | 6/1972 | Dubrfuil et al. . | |
| 3,681,835 | 8/1972 | Evans et al. . | |
| 3,946,768 | 3/1976 | Fiorentino . | |
| 4,049,025 | 9/1977 | Gillingwater . | |
| 4,292,834 | 10/1981 | Tishler et al. . | |
| 4,483,373 | 11/1984 | Tarbox . | |
| 5,168,904 | 12/1992 | Quinkert . | |
| 5,632,086 | 5/1997 | Helwig . | |

OTHER PUBLICATIONS

Package insert, "Wire Bending Jig," 1964.

*Primary Examiner*—Lowell A. Larson
*Attorney, Agent, or Firm*—Klarquist Sparkman Campbell Leigh & Whinston

[57] ABSTRACT

A wire bending jig adapted for jewelry manufacture having one or more arrays of holes for receiving bending pins. The jig has means to hold the tare end of the wire stock, freeing the hands for the work of bending wire. The bending jig may be held in one hand, mounted to a work table, or mounted in tandem on a base for complex tool construction.

20 Claims, 3 Drawing Sheets

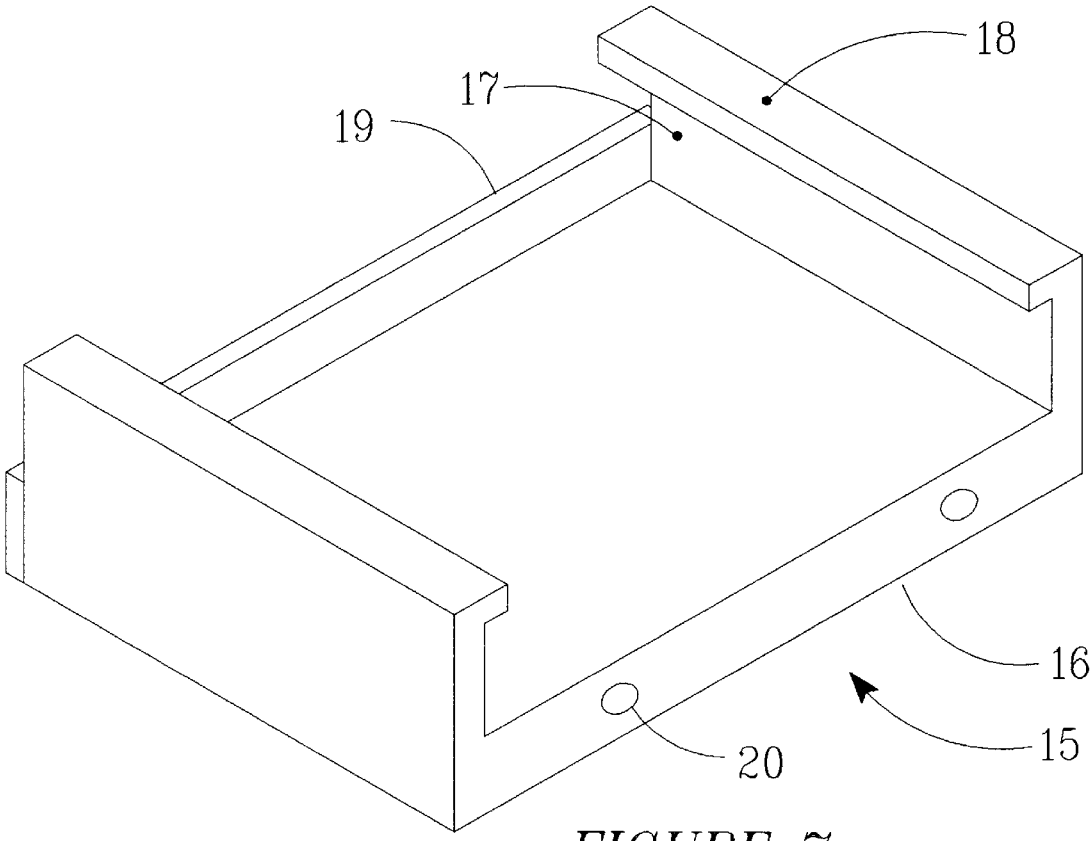
FIGURE 7
FIGURE 8
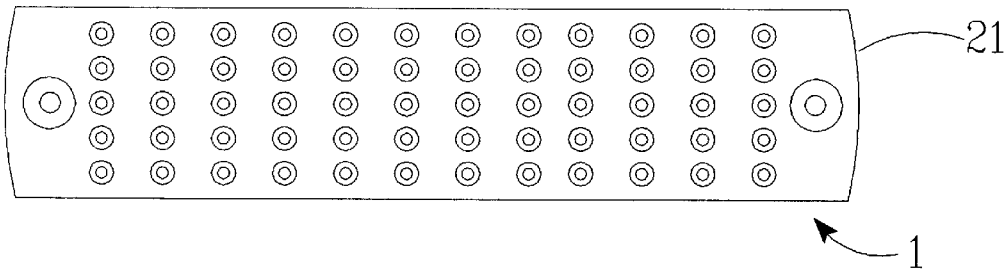
FIGURE 9
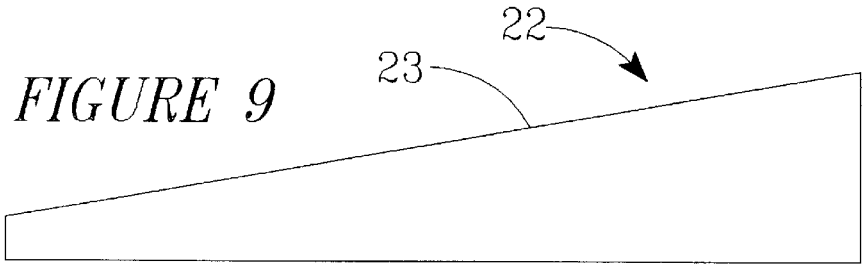

WIRE BENDING JIG FOR JEWELRY MANUFACTURE

BACKGROUND OF THE INVENTION

1. Field of Invention

This invention relates in general to wire bending tools and in particular to benders for fabrication of jewelry components comprising wire.

2. Description of Prior Art

In the prior art, products constructed of bent wire or rod are often made utilizing bending jigs with pins around which wire or rod material is bent into the shapes specific to the application.

Components for manufactured goods, including reinforcing rod for cast concrete, usually are required to be uniform in shape and the dimensions are determined by the use to which they are put. Thus, a custom made jig is an ideal tool for bending the feed stock for such components.

Such jigs and associated tools are easily and inexpensively fabricated to produce the infinite variety of products varying in size, shape, and material. Heavy bending jigs even for heavy rod stock such as reinforcing bar can easily be constructed without resorting to machine shop facilities by welding common pipe and plate. Light bending jigs are often merely nails driven into a sheet of plywood. Therefore, there is little incentive for the development of generalized adjustable bending or wire harness tooling.

Jewelry on the other hand, seldom has tight predetermined dimensional requirement, but similar pieces used together should be similar enough to be pleasing to the user. A jig is an ideal tool to nearly identical parts or parts with minor artistic differences identifying the parts as hand made. For jewelry, the absence of a specific dimensional requirement permits the pins to be placed in a pattern with a discrete resolution such as is characteristic of a grid or array pattern.

The volume of similar parts made in a jewelry project is usually rather small and there usually are several sets of similar parts, sometimes in graduated sizes. A jig or set of jigs each having several fixed bending points can be used to fabricate a variety, but finite number, of shapes. Therefore, an adaptable jig proves useful to jewelry artisans and other craft producers.

U.S. Pat. No. 5,632,086, by Gary Helwig, is a typical fixed jig having 4 bending pins spaced for the construction of several wire sculptures. Helwig's company also catalogs fixed bending jigs with other patterns for construction of other wire jewelry shapes. Fixed jigs in the prior art do not have general means to retain the beginning end of the wire being bent, therefore, the end must be held by with a pair of pliers until the wire workpiece is bent sufficiently to tend not to move the loose starting end away from its initial position.

One patent shows an adjustable frame having bars with T slots to receive threaded bending pins adapted for use as a wire harnessing jig. Wire harnesses are large structures and there is very little load placed on the bending pins which have a primary function to hold the bundle of wires prior to tying with cord or tape. There is no significant stress applied by the action of bending the usually very flexible wires. This invention is not adaptable to small jig frames because of the size of the T slot holding bars. The wire harness jig requires tools to change and cannot be made usefully small enough to be hand-held.

Although various types of wire bending jigs have been disclosed in the prior art, and some have been designed for use with small diameter wire and the shapes particularly useful for wire jewelry and wire components such as springs and retainers, none have the flexibility of assembly to comprise a universal bending jig capable of re-configuration to make components meeting the specifications of end uses.

SUMMARY OF THE INVENTION

An illustrative embodiment of the present invention is a hand held tool for bending wire into shapes of various sizes and shapes. The tool is a set of mandrels and a holding block with an array of holes for retaining the mandrels in a position whereby wire can be wrapped around the various mandrels in a procedure and pattern resulting in an artist's jewelry product.

A rigid bar, preferably of aluminum, is perforated with an array of holes. The array spacing is specifically sized to best utilize standard jewelry findings readily available in the art's marketplace. Alternative array spacing for special purposes is anticipated.

A set of removable mandrels which are pins inserted into the array in a pattern determined by the design of the intended part to be made on the tool. Wire is looped around the pins and traverses the array in the pattern of the intended part, thereby forming an article or component of an article of jewelry or other application.

Each pin receiving hole of the array has a larger bore for receiving a pin and a terminal bore of a smaller diameter forming a shelf the near the bottom upon which a pin inserted into larger bore rests. The holes are bored through the bar to permit a wire to pass completely through. The shelf prevents the pins from falling through the holes.

The shelf or step is beveled so that a wire end pushed through the hole is deflected off the step and allowed to continue through the bar, where it may be left dangling or kinked over to retain the wire end.

The pins and holes are precision fitted to provide stability for the pins against the forces of bending. This reduces wear on the holes, keeps the pins from working out of the holes, and maintains precision of spacing when the wire is being bent near the top of the pin.

In addition, the bar has holes for bolting the tool to a stabilizing plate, work table, or a baton for easier and more secure holding by the hand.

An embodiment has a plurality of overlapping arrays of pin holes for more variations in pin position.

Another embodiment utilizes a mounting base where various configurations of the basic array plates can be positioned in adjustable relation to each other to form complex jig foundations.

BRIEF DESCRIPTION OF THE DRAWINGS

FIG. 7 is a holding fixture for holding a plurality of the wire bending jigs.

FIG. 8 is a bending jig adapted specifically for use in the holding fixture of FIG. 7.

FIG. 9 is a wedge for spacing and turning the bending jig of FIG. 8 when installed in the holding fixture of FIG. 7.

DETAILED DESCRIPTION OF THE PREFERRED EMBODIMENT

The wire bending jig described herein is a set of mandrels and a holding block with an array of holes for retaining the mandrels in a position whereby wire can be wrapped around the various mandrels in a procedure and pattern resulting in an artist's jewelry product.

Figure 1:
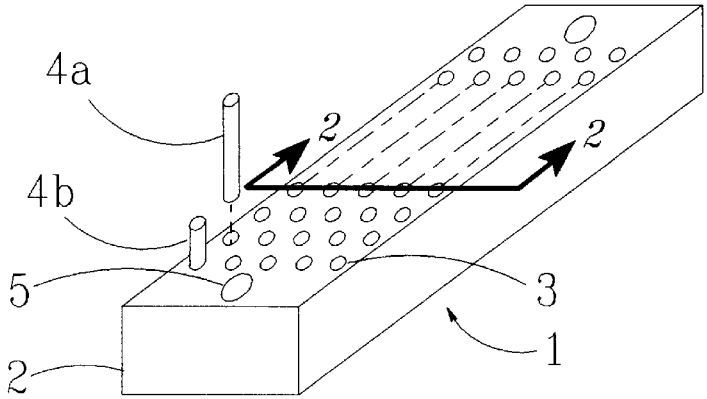
FIG. 1 is an overall view of one embodiment of the re-configurable tool depicting the array of bending pin positioning locations.
Figure 2:
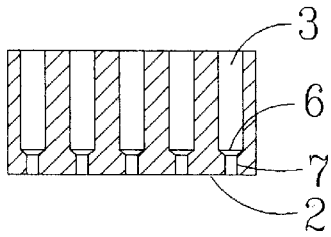
FIG. 2 is a cross section of FIG. 1 showing details of the pin receiving holes.

Referring to FIG. 1, the bending jig, 1 generally, is a bar 2 of sturdy material, preferably 6062 aluminum for light weight and durability, drilled with an array of holes as shown in cross section in FIG. 2. For light duty, plastic such as polycarbonate or polystyrene may be substituted for metal. Bushings of metal may be used to line the pin receiving holes for greater durability.

Referring to FIG. 2, the pin receiving holes 3 are counterbored to near the bottom surface of the bar and extend through the bar in narrowed diameter 7. The narrowed diameter 7 of the pin receiving hole is to form a bottoming stop to limit the depth which the bending pins enter into the tool. The preferred diameter of 7 is approximately 0.032 inches smaller than the pin receiving portion.

The bottom of the counterbore in conjunction with the narrowed bore forms a constriction or shelf in the through-hole which functions as a stop to limit the entry of the pin into the block. The end of the counterbore is beveled to a conical shape of approximately 135 degrees included angle, the angle may be decreased to enhance the ability to pass a wire through the bore unimpeded. The angle must not be decreased to the point that the pins 4*a* 4*b* tend to jam into the cone. The actual lower limit is a function of the angle of the bevel on the pins, but 90 degrees is a good practical limit to observe. The maximum angle is approximately 170 degrees.

Because jewelry is often designed with symmetry, it is desirable to have an odd number of pins positions in the shorter side of a rectangular array. A row having 5 positions has been found to be the minimum required for a general-use tool. Of course, as more pin positions are added, the actual need for an odd number diminishes rapidly and vanishes at 10 to 12 pin positions. Even though the utility value of the tool is satisfied, a psychological need stemming from a human preference for symmetry and balance continues. The amount and effect depends on the intuition of the artist user.

The preferred bending pin 4*a* 4*b* for general wire jewelry making is ⅛ inch diameter. Other diameters are required for small parts and larger loops.

Any round rod cut and deburred on the ends will suffice for pins, the pin shape is approximately a right-cylinder. The cylinder end edges may be square cut, beveled, rounded, or spherical. Square cut being the least desirable as the sharp edges may cut the operator and scrape material from the receiving holes. Common toolmakers precision dowel pins are preferred as they are available in a selection of lengths and diameters, are precision ground, polished, and beveled or rounded. Toolmaker's dowel pins are readily available in commerce at modest prices. One source is EZ Sockets, Inc. Springfield, N.J.

The pin receiving hole for ⅛ inch dowel pins is approximately 0.44 inches deep and is drilled or reamed for an ASA standard snug (class 4) or medium (class 3) fit. For small diameter pins, a free (class 2) fit is acceptable. For ⅛ inch pins, a hole of 0.126 ±0.0005 diameter has been found to be practical to fabricate and is a slip fit with imperceptible wiggle.

Toolmaker's dowel pins, being designed for wringing (class 5) and tight (class 6) fits, have closer tolerances than listed above, therefore, the overall tolerance of the pin and hole combination is less and the fit more uniform and tighter is better when toolmaker's dowel pins are used.

A close tolerance fit causes the pin to slide co-axially into the receiving hole, reducing wear by reducing build-up of scraping-like forces occurring if the pin is inserted tilted off-axis.

In addition to the array of pin receiving holes, at least one additional hole 5, generally two, is provided for bolting or screwing the bar to a handle, stabilizing board or table top. Mounting holes 5 may be of any convenient size, preferably for a number 6 or 8 screw or bolt. Countersinking is recommended to lower the fastener head flush with or below the working surface of the bar, thus avoiding the possibility of the fastener head interfering with the working motion of the wire.

Figure 4:
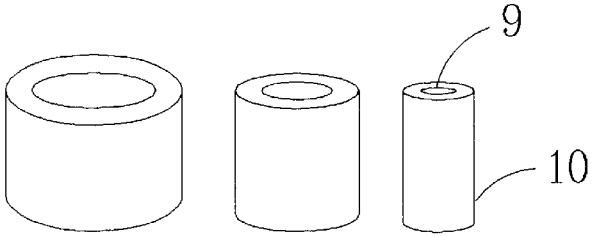
FIG. 4 is a view depicting the diameter expanding collars.

Often it is desirable to bend wire around a larger radius than provided for by the bending pin. Bending pins may be constructed with sections of different diameters. One for inserting into the bar and a different radius for the portion where bending takes place. Such pins can be easily fabricated in quantity using some form of metal turning lathe. One such lathe adapted for mass producing small items turned from rod stock is called a "screw machine". However, various radii can more easily be installed by placing collars over the pins. FIG. 4 illustrates a set of collars having concentric inner 9 and outer surfaces 10 and length approximately the length of the bending pin protruding from the holding bar. Each collar may have the internal bore sized to fit snugly over the bending pin, or the larger collars may have inner bores sized to fit over one of the smaller collars, as illustrated in FIG. 4. Collars may also be grooved on the outer surface (not shown) to support the wire above the bar surface. Collars may also be stepped with several outer diameters.

The preferred array spacing for hand made jewelry construction is a rectangular grid 0.188 by 0.250 inch, with the 0.250 dimension being along the long axis of the bar. Obviously, other spacing and pin sizes are useful for specific tasks and different scale bent-wire articles. Neither is it a specific requirement of the invention that the array of pin holding holes be rectangular. Some jewelry designs can benefit from non-parallel rows of bending pin holders.

The specific dimensions of approximately 0.188 and 0.250 inch provide two very useful open spacing between the pins. These dimensions are found to be very appropriate to leave adequate length between consecutive loops and bends of the piece for accommodating industry standard jewelry findings, beads, bangles, and other components regularly sold for wire jewelry art. In general, an array for jewelry bending jigs is sized to provide two functions; pin diameter for controlling loop sizes, and free length of wire between loops. Thus the critical dimensions are not center to center spacing, but OD to OD, ie, between the exterior surfaces of the pins.

OTHER EMBODIMENTS AND VARIATIONS

Figure 3:
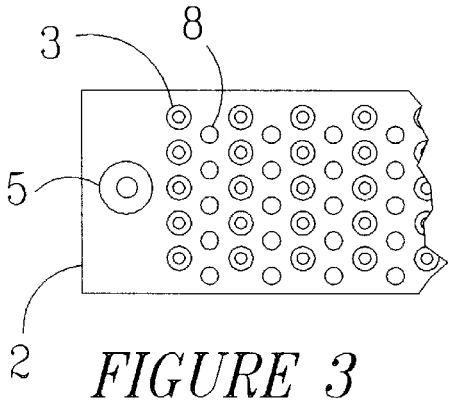
FIG. 3 is a view of an embodiment having two arrays of pin holes of different sizes.

FIG. 3 illustrates a dual array embodiment of the bending jig. The second array has the same spacing as the first array, but is offset ½ cycle to take maximum advantage of the interstitial spaces between the holes 3 of the first array. The pin receiving holes 8 of the second array may have the same diameter as those in the first array, but preferably, are approximately ⅔ to ½ the diameter of the first arrays holes. Since there are sufficient through holes from the first array to anchor the wire end, it is not necessary that the holes of the second array pass through bar 2.

The offset and smaller pin sizes of the second array provide an additional set of open spaces between the pins of differing lengths. Offsetting the pins some distance other than ½ cycle in either or both directions makes additional distinctly different open spaces.

FIG. 7 depicts a mounting fixture for receiving and holding a plurality of jig blocks such as illustrated in FIGS. 1, 3, 5, and 8.

The mounting fixture 15 generally, comprises a base 16, end pieces 17, holding flanges 18, and side walls 19. End pieces 17 and side walls 19 are present in pairs. The side walls are plates fastened to the base by bolts through the wall and into threaded holes 20. The second of the pair of side walls 19 is not explicitly shown, but it is a right-hand version of the side wall shown on the left side.

The bending jig blocks 1 are slipped into the mounting fixture with the ends 21 under the holding flanges. Spacers having similar length, and thickness as the jig blocks, but without pin receiving holes and having various widths, are placed between the working bending jigs to hold them in position. Some spacers, 22 generally, may be wedge shaped as shown in FIG. 9, where side 23 is angled relative to the opposite side.

There is no requirement that all the bending blocks be identical. Blocks of differing spacing, hole/pin sizes, array patterns, fixed, or customized may be used to add diversity and utility to the tool.

One useful set of spacers has widths in binary progression. That is, in 1, 2, 4, 8, . . . width units relative the preferred jig block. Binary progression has combinations in increments of 1 unit. A unit is preferably the hole spacing in the narrow direction of the block shown in FIG. 8. Other spacer size progressions or custom sizing are permitted to meet particular needs of any setup.

The distance between the end pieces is not more than 0.02 inches larger than the bending jig. To permit the bending jig elements to be mounted at an angle, it is preferred that the ends of the jig bar be curved with a radius of ½ the length of the bar. This permits the jig to be rotated within the holding fixture.

The inside height of the end pieces is not more than 0.02 larger than the thickness of the bending jig and spacer bars. It is permitted that the jig bar ends be thinned approximately the thickness of the holding flanges. This makes the work surface of the jigs flat preventing interferences with the wire from the holding flanges.

Figure 10:
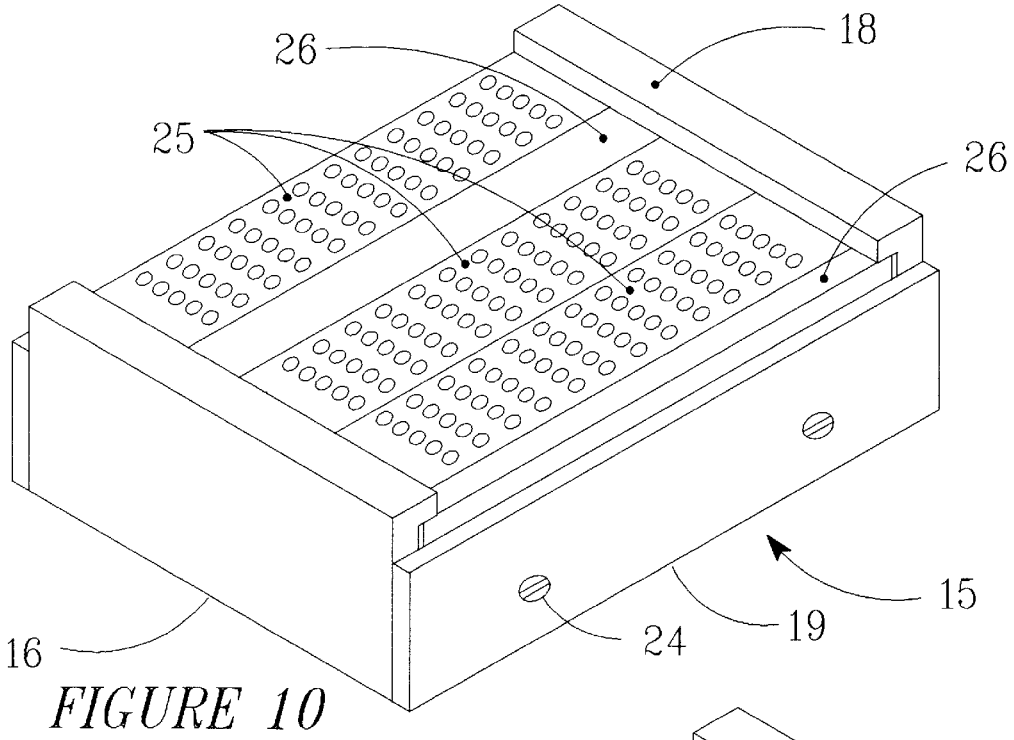
FIG. 10 illustrates the holding fixture loaded with bending jigs and spacers and ready for use.
Figure 11:
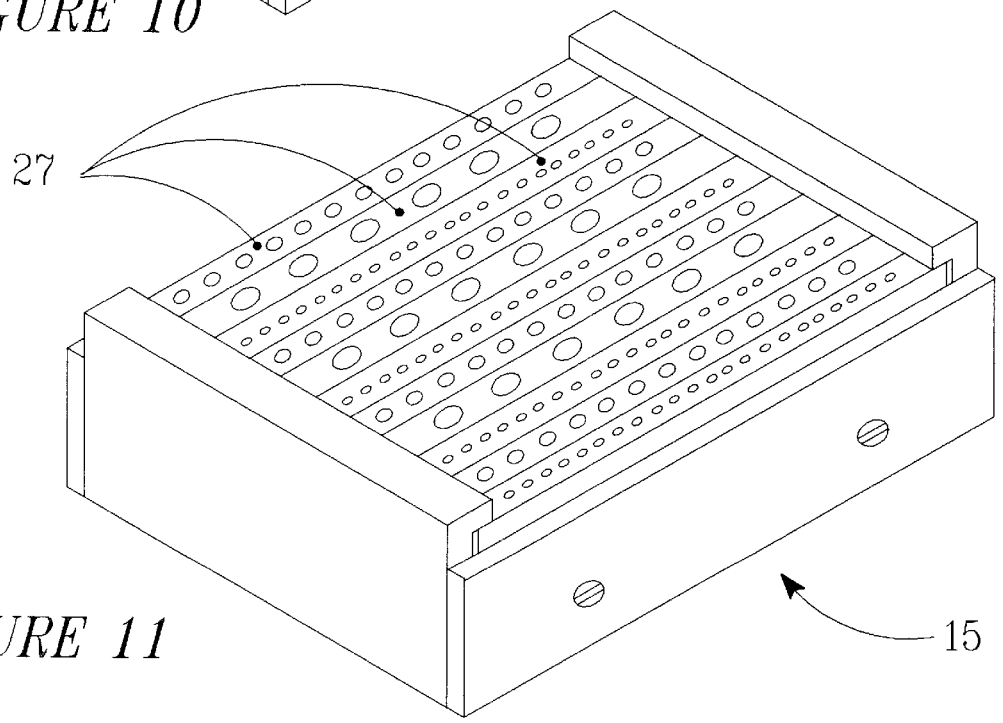
FIG. 11 illustrates the holding fixture loaded with bending jigs having various sizes of holes for pins.

Refer to FIG. 10. The mounting fixture 15 is filled with bending jigs 25 and spacers 26, then closed by installing the last side wall 19 with screws 24. FIG. 11 shows the same mounting fixture loaded with a variety of single row bending jigs having various pin sizes and spacing. Of course, multi-row and fixed-pin jigs may be interspersed with single row jigs.

HOW TO USE THE ILLUSTRATED EMBODIMENT

The bending jig maybe held directly in the hand, but it is more convenient to mount it on something capable of providing more stability. For individual use, one convenient handle is to mount it on a wooden block or baton which is then gripped by the hand or clamped to a work table. Alternatively, the jig may be clamped in a bench vise or mounted directly on the work table. In each of these, it is preferred that a space of at least ⅛ inch be left under the jig to allow the passage of the wire end. The space is usually provided by inserting a spacer between the jig body 2 and the mounting block. Mounting utilizes the holes 5 provided for this purpose.

The universal mounting base of FIG. 7 may be used to hold one, or combine several of the tools shown in FIGS. 1 or 3 to form a more complex or larger working tool. FIG. 10 illustrates the universal mounting base loaded with bending jigs and ready for use.

Prior to setting the bending pins, it is usual to draw a full size sketch or to hand-bend a model of the product to be constructed.

Figure 5:
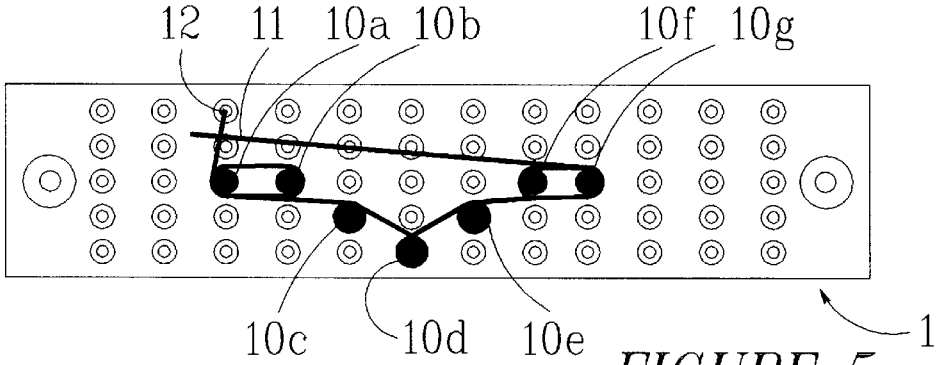
FIG. 5 illustrates the basic bending jig in use for constructing a wire brooch.
Figure 6:
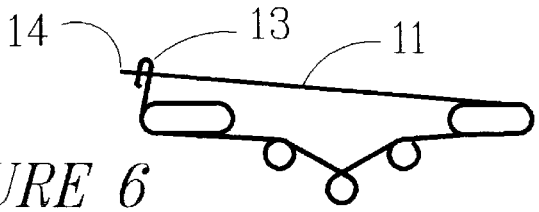
FIG. 6 depicts the finished brooch, ready for use or embellishment.

FIG. 5 shows the basic bending jig ready for constructing a wire brooch. The finished product is shown in FIG. 6.

Referring to FIG. 5, the bending pins are placed in the jig 1 in a pattern as closely resembling the bend points of the product as is permitted by the resolution of the pin holding array. In the example these are pins 10*a*, 10*b*, 10*c*, 10*d*, 10*f*, and 10*g*. In this example, the pin pattern is symmetrical about pin 10*d*. Symmetry is a characteristic of the example, and not a general requirement.

One end of wire 11 is passed through a nearby hole 12 which holds the loose end while forming the rest of the brooch. Wire 11 is then bent around the pins 10 in the sequence and direction determined by the previously prepared design sketch, model, or the immediate creative whim of the artist.

In this particular case, the last bend takes the wire past the first pin 10*a* and beyond the first wire end where it is cut off. The unfinished brooch is removed from the form. Referring now to FIG. 6, the clasp hook 13 is hand bent on the end of the first wire end, and the last wire end is sharpened 14. This completes the basic brooch manufactured utilizing the present invention. The brooch may then be worn as produced or it may be embellished with bangles, ribbons, or whatever the artist desires. This particular design also has utility as a man's tie tack.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention as defined by the claims which follow.

The embodiments of the invention in which an exclusive property right or privilege is claimed are defined as follows:

1. A tool kit for bending wire into shaped articles comprising:

a. a base block having an upper and lower surface and;

b. a mandrel for bending wire consisting of a plurality of pins having an essentially cylindrical shape and;

c. a plurality of cylindrical holes for receiving said pins, wherein said holes traverse through said block between said upper and lower surfaces, each hole having a first portion and a second portion in essentially co-axial alignment and;

d. said first portion of said cylindrical holes having a diameter larger than the diameter of said cylindrical pins, and said second portion having a diameter approximately 0.032 less than the diameter of said cylindrical pins, wherein said first and second portions cooperate to form a shelf at the conjunction of said portions and;

e. said conjunction of said first and second portions of the cylindrical holes being proximal to lower block surface and;

f. wherein a plurality of said pins is inserted into said cylindrical pin receiving holes in a pattern of pins determined by the by the characteristic shape of the article.

2. Said shelf of claim 1 having a conical shape with an included angle of between 170 degrees and 90 degrees.

3. Said block of claim 1 having a mounting means for attaching said block to a handle;

said mounting means being at least one hole extending through the upper and lower surfaces of said block;

whereby an attachment means is passed through said mounting means thus attaching said block to said handle.

4. Said plurality of cylindrical pin receiving holes of claim 1 being arranged in an essentially rectangular array having a longer side and a shorter side and having at least 5 holes across the shorter side.

5. The tool kit of claim 1 further comprising:

said plurality of cylindrical pins of claim 1 having a first set of pins and a second set of pins, the sets having different diameters and;

said plurality of cylindrical pin receiving holes of claim 1 being a first array of holes for receiving pins from said first set of pins, and a second array of holes for receiving pins from said second set of pins and;

said first array of holes being arranged in an essentially rectangular array having a longer side and a shorter side and having at least 5 holes across the shorted side and;

said second array of holes being arranged in an essentially rectangular array having a longer side and a shorter side and having at least 5 holes across the shorter side and;

said second array offset from said first array wherein the holes said second array are interspersed between the holes of said first array.

6. The holes of the second array of claim 5 extending from the upper surface to approximately the lower surface of said base block.

7. The tool kit of claim 1 further comprising:

at least one means for enlarging the diameter of the said mandrel, wherein said means for enlarging the diameter is a bushing having an inner bore essentially the diameter of the mandrel and an outer coaxial cylindrical surface.

8. The tool kit of claim 1 further comprising:

at least one means for enlarging the diameter of the said mandrel, wherein the mandrel pin of claim one having at least two portions having different diameters, wherein one portion is adapted for insertion into said pin receiving holes and a mandrel portion for forming wire.

9. Apparatus for forming shaped-wire jewelry articles comprising:

a base, said base defining a first and second groups of holes extending at least part way therethrough, the holes of the first group each having a first diameter, the holes of the second group each having a second diameter less than the first diameter;

plural first pegs, said first pegs each having a diameter sized to be removably and matingly received within the holes of the first group;

plural second pegs, said second pegs each having a diameter sized to be removably and matingly received within the holes of the second group;

the first group of holes comprising plural uniformly-spaced rows of holes;

the second group of holes comprising plural uniformly-spaced rows of holes.

10. The apparatus of claim 9 wherein holes in the second group of holes are in staggered relationship with holes in the first group of holes, and wherein:

a hole in the first group is centrally located between, and equidistant from, four holes in the second group; and a hole in the second group is centrally located between, and equidistant from, four holes in the first group.

11. The apparatus of claim 9 in which holes in at least certain of said first and second groups of holes do not extend through the base with constant diameter.

12. The apparatus of claim 11 in which holes in at least certain of said first and second groups of holes extend though the base, but have a smaller diameter at a bottom of the base than at a top thereof.

13. The apparatus of claim 12 in which holes in at least certain of said first and second groups of holes have a stepped change in diameter between the top and bottom of the base, rather than a gradual taper therebetween, said stepped change including a bevel, the bevel facilitating passage of a wire therethrough.

14. The apparatus of claim 12 in which the pegs are of uniform diameter along their length.

15. The apparatus of claim 9 in which the base comprises an elongated block of metal having mounting holes centrally formed in opposite ends thereof, said mounting holes having a diameter larger thin the second diameter.

16. The apparatus of claim 15, wherein the mounting holes are chamfered, but the holes of the first and second groups are not.

17. The apparatus of claim 9, further comprising a length of wire sized to fit between pegs positioned in the holes in the base, and to be shaped therearound.

18. Apparatus for forming shaped-wire jewelry articles comprising:

a base, said base defining plural holes extending therethrough, said holes being arrayed in uniformly-spaced rows, at least certain of said holes each having a stepped diameter therealong, with a first diameter along a first portion extending between a top side of the base and an intermediate transition region, and a second, smaller diameter along a second portion extending between said intermediate transition region and a bottom side of the base; and plural pegs, said pegs each having a diameter sized to be removably and matingly received within the first portions of said holes.

19. The apparatus of claim 18 in which said certain holes each defines a bevel at the transition region, to facilitate passing a wire therethrough to anchor the wire to the base.

20. The apparatus of claim 18, further comprising a length of wire sized to fit between pegs positioned in the holes in the base, and to be shaped therearound.

* * * * *